US009419732B2

(12) United States Patent
Ravindran et al.

(10) Patent No.: US 9,419,732 B2
(45) Date of Patent: Aug. 16, 2016

(54) SYSTEMS AND METHODS FOR OPTIMIZED DECODING OF IN-BAND ON-CHANNEL (IBOC) SERVICES

(71) Applicants: Binuraj K. Ravindran, Cupertino, CA (US); Dongsheng Bi, Fremont, CA (US)

(72) Inventors: Binuraj K. Ravindran, Cupertino, CA (US); Dongsheng Bi, Fremont, CA (US)

(73) Assignee: Intel Corporation, Santa Clara, CA (US)

( * ) Notice: Subject to any disclaimer, the term of this patent is extended or adjusted under 35 U.S.C. 154(b) by 924 days.

(21) Appl. No.: 13/629,970

(22) Filed: Sep. 28, 2012

(65) Prior Publication Data

US 2014/0094111 A1 Apr. 3, 2014

(51) Int. Cl.

| | |
|---|---|
| ***H04H 20/74*** | (2008.01) |
| ***H04H 20/53*** | (2008.01) |
| ***H04H 60/46*** | (2008.01) |
| ***H04H 60/65*** | (2008.01) |
| *H04H 60/37* | (2008.01) |

(52) U.S. Cl.

CPC ..... *H04H 20/53* (2013.01); *H04H 60/46* (2013.01); *H04H 60/65* (2013.01); *H04H 60/37* (2013.01); *H04H 2201/18* (2013.01)

(58) Field of Classification Search

CPC ..... H04L 1/004; H04L 1/005; H04L 1/0057; H04L 1/0059; H04L 1/0071; H04L 25/0224; G06F 11/1625; H03M 13/09; H03M 13/112; H03M 13/27; H03M 13/2906; H03M 13/6337; H04H 2201/18; H04H 60/37

USPC ..... 455/3.02, 3.01, 3.06; 375/262, 265, 375/340; 701/533; 704/201

See application file for complete search history.

(56) References Cited

U.S. PATENT DOCUMENTS

| | | | | |
|---|---|---|---|---|
| 5,898,732 | A | 4/1999 | Dapper et al. | |
| 6,985,537 | B1 * | 1/2006 | Milbar | H04L 27/2602 370/344 |
| 2006/0046685 | A1 | 3/2006 | Hjelmeland | |
| 2011/0202270 | A1 * | 8/2011 | Sharma | G06Q 30/02 701/533 |
| 2011/0213681 | A1 | 9/2011 | Shahid | |
| 2012/0028567 | A1 * | 2/2012 | Marko | H04W 4/20 455/3.02 |

OTHER PUBLICATIONS

International Search Report and Written Opinion received for PCT Patent Application No. PCT/US2013/048548, mailed on Oct. 10, 2013, 17 pages.

Peyla, et al., "Structure and Generation of Robust Waveforms for FM In-Band On-Channel Digital Broadcasting", Broadcast Engineering Conference Proceedings, 56th, Jun. 13, 2002, 17 pages.

* cited by examiner

*Primary Examiner* — Shaima Q Aminzay

(74) *Attorney, Agent, or Firm* — Sutherland Asbill & Brennan LLP

(57) ABSTRACT

Certain embodiments herein are directed to optimized decoding of in-band on-channel (IBOC) services, such as audio, traffic, and data associated with HD Radio™. Service information, such as service boundaries for one or more segments associated with IBOC services, may be identified and formatted for transmission to a receiver device. The receiver device may use the service boundaries to select or filter segments associated only with a service of interest from a bit stream of segments associated with one or more other services, according to one embodiment.

14 Claims, 9 Drawing Sheets

SYSTEMS AND METHODS FOR OPTIMIZED DECODING OF IN-BAND ON-CHANNEL (IBOC) SERVICES

TECHNICAL FIELD

Embodiments of this disclosure relate generally to wireless in-band on-channel (IBOC) signals, and more particularly, to decoding wireless IBOC signals.

BACKGROUND

Wireless IBOC signals may include information associated with one or more services, such as audio, traffic, or data services for HD Radio™. Less than all of the services in an IBOC signal, however, may be of interest to a receiver device that receives the signal. Existing receiver devices may nevertheless store all received services in a memory and subsequently determine which of the stored services are applicable to the receiver device. Such determinations may require more memory than is necessary for processing services of interest, which may be inefficient and costly. Furthermore, existing standards that prescribe formats for communicating IBOC information may not provide information that facilitates more efficient processing of IBOC information.

BRIEF SUMMARY

Certain embodiments herein are directed to optimized decoding of in-band on-channel (IBOC) services, such as audio, traffic, and data associated with HD Radio™. Service information, such as service boundaries for one or more segments associated with IBOC services, may be identified and formatted for transmission to a receiver device. The receiver device may use the service boundaries to select or filter segments associated only with a service of interest from a bit stream of segments associated with one or more other services, according to one embodiment.

BRIEF DESCRIPTION OF THE FIGURES

The detailed description is set forth with reference to the accompanying figures. In the figures, the left-most digit(s) of a reference number identifies the figure in which the reference number first appears. The use of the same reference numbers in different figures indicates similar or identical items.

Figure 1:
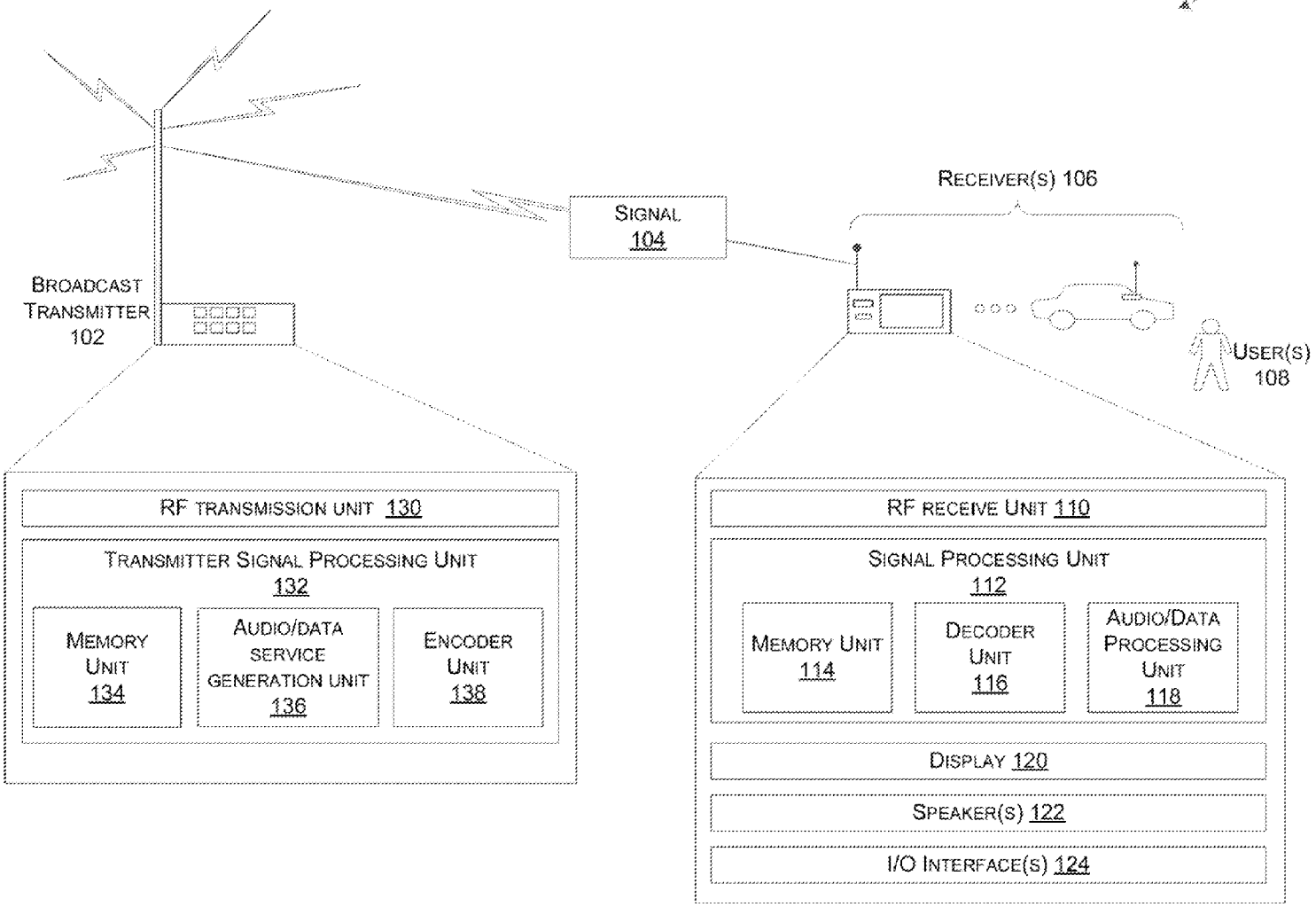
FIG. 1 illustrates a system for encoding and decoding IBOC signals, according to one embodiment of the disclosure.

Certain implementations will now be described more fully below with reference to the accompanying drawings, in which various implementations and/or aspects are shown. However, various aspects may be implemented in many different forms and should not be construed as limited to the implementations set forth herein; rather, these implementations are provided so that this disclosure will be thorough and complete, and will fully convey the scope of the disclosure to those skilled in the art. Like numbers refer to like elements throughout.

DETAILED DESCRIPTION

Certain embodiments herein are directed to, among other things, optimized decoding of in-band on-channel (IBOC) services. IBOC may refer to a hybrid method of transmitting digital radio and analog radio signals simultaneously on the same frequency. A broadcast transmitter device may generate such signals to include one or more IBOC services, such as audio, traffic, or data services for transmission to a receiver device. To facilitate a receiver device decoding an IBOC service, the transmitter device may identify and include certain service information in packets or segments associated with the IBOC services. Examples of such service information may include an identification of the type of IBOC service associated with the segments, one or more logical channels over which the segments will be transmitted, a number of segments associated with the type of IBOC service, a respective start bit for the segments, and a respective length of the segments, or other service boundary information.

A receiver device, upon receiving the service information, may use the service information to identify boundaries for segments associated with a service of interest, such as a station or channel selected by a user utilizing the receiver device. For example, a jazz music channel by a user utilizing the receiver device may be referred to as a service of interest. Thus, audio and data packets, for example, associated with the jazz music channel may be of interest to a receiver device. By leveraging service boundary information, such as the start bit and length of a segment, a receiver device may select only those bits associated with a service of interest from a bit stream of segments that may include one or more other services. Such a configuration may require less than a total amount of memory available at a receiver device, and therefore, may optimize use of the memory and hence decoding of IBOC services.

According to one configuration, a receiver device may include a signal processing unit, which may include a decoder, and one or more modules associated with the signal processing unit. The signal processing unit may include a physical layer (or layer 1) for processing service data associated with a service of interest and a data link layer (or layer 2) for processing service information. In one embodiment, a service boundary extraction module in layer 2 may determine the service boundaries for segments associated with a service of interest and may provide the service boundaries to a physical layer segment planner module in the physical layer of the signal processing unit. The physical layer segment planner may designate segments in a bit stream of segments associated with one or more services based at least in part on the service boundaries, configure a convolutional decoder to decode the designated segments, and translate the service boundaries into addresses that may be used by an address filter module to select or filter bits associated with a service of interest. The filtered bits may be stored in a memory and processed. Such processing may include, but is not limited to, manipulating the filtered bits, such as by decompressing or reformatting the filtered bits to a format suitable for outputting at a receiver device, for example. After the filtered bits are processed, the filtered bits, or a representation of the filtered bits based at least in pan on the processing, may be output to at least one of a speaker, display, etc., associated with the receiver device, in one embodiment.

By filtering a bit stream to obtain only one or more designated services of interest, memory and processing requirements may be reduced. Such reductions may be realized because the amount of data to be processed by a receiver may be reduced to only data associated with services of interest. Such reductions may be further facilitated by a memory allocation module in a receiver device which may dynamically allocate memory between layer 1 and layer 2 as may be required to more efficiently process service data.

FIG. 1 depicts a system for encoding and decoding IBOC signals, according to one embodiment of the disclosure. As shown in FIG. 1, a broadcast transmitter device 102 may emit a signal 104 to one or more receiver devices 106. To enable the transmission of bit streams as described herein, the transmitter 102 may include a radio frequency (RF) transmission unit 130 and a transmitter signal processing unit 132. The transmitter 102 may also be coupled to an antenna that may send the signal 104 to the receivers 106.

The signal processing unit 132 may include a memory unit 134, an audio/data service generation unit 136, and an encoder unit 138. The audio/data service generation unit 136 may perform various functions, such as identifying and packetizing information associated with one or more services, among other functions. For example, the audio/data service generation unit 136 may identify service information for services that is broadcast to receiver devices. Such service information may include service boundaries for segments associated with the services, as well as other information. Examples of service information may include, but is not limited to, a starting offset bit for the segments, the length of the segments, the number of segments, a channel over which the segments may be transmitted, and the type of service associated with the segments, as non-limiting examples. The service information may be available in one or more databases or other storage mechanisms (not shown). Certain embodiments herein may leverage the service information to facilitate a receiver device's more efficient decoding of IBOC services, as will be described in greater detail below.

Figure 2:
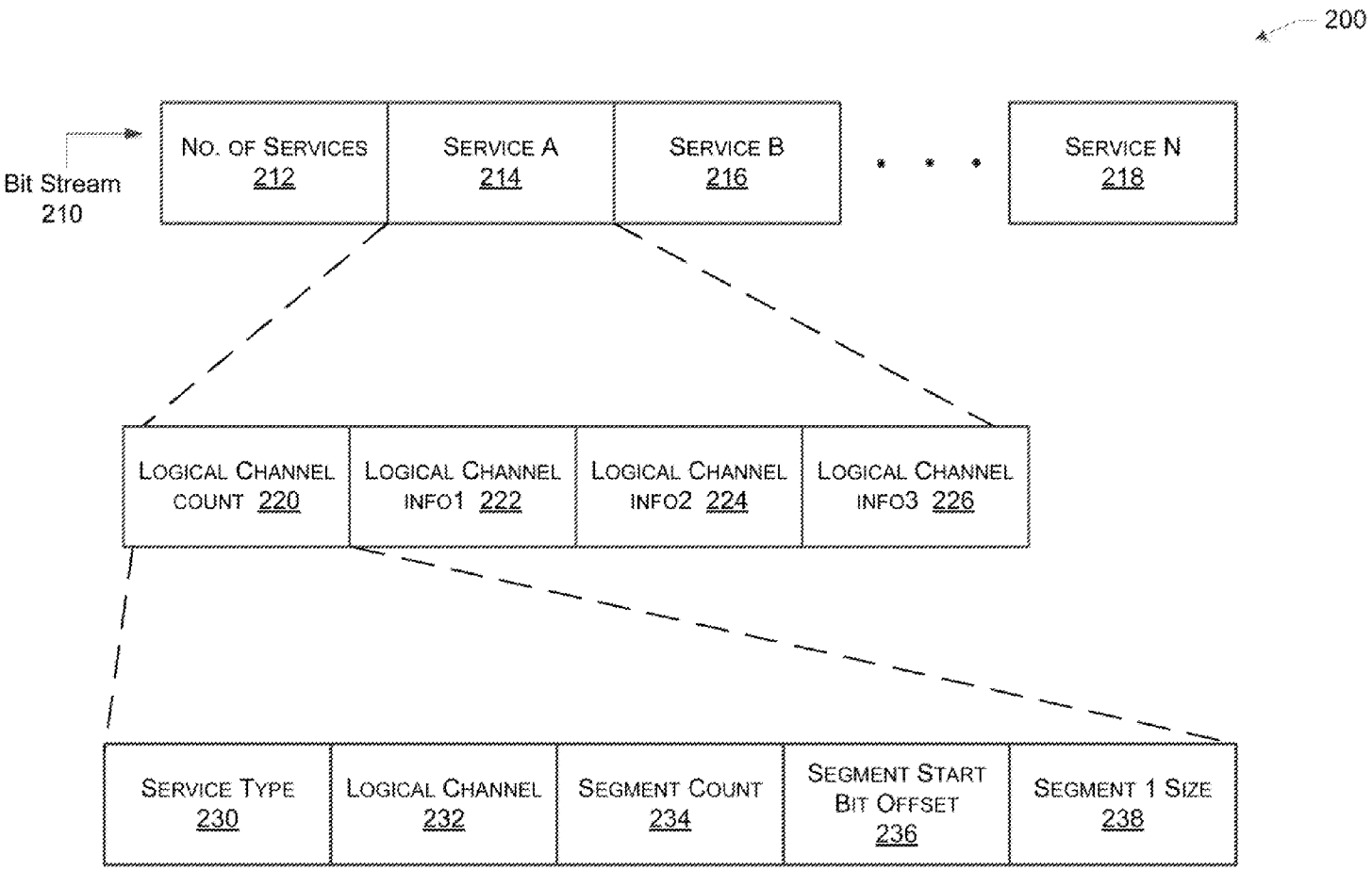
FIG. 2 illustrates service information from one of multiple segments in a bit stream of frame segments, according to one embodiment of the disclosure.

The audio/data service generation unit 136 may also generate a packet or segment that includes the service information for transmission to a receiver device. One or more of such segments may be included in a bit stream. FIG. 2 illustrates such a configuration, according to one embodiment. For example, the bit stream 210 may include an indication 212 of the number of services, such as Service A 214, Service B 216, Service N 218, etc. Each of these services may be associated with one or more logical channels, which may be used to carry one or more segments associated with the services. For example, as shown in FIG. 2, Service A 214 may include a logical channel count 220, which may indicate a number of channels that are utilized for carrying segments associated with the service, and information associated with each logical channel, e.g., logical channel info1 222, logical channel info2 224, and logical channel info3 226. Further, service information that may further define a service may be may be associated with each logical channel. For example, as shown in FIG. 2, logical channel count 220 may include a service type 230, a logical channel 232, a segment count 234, a segment 1 start offset, and a segment 1 size, among other information. The same or similar information may be included for multiple segments, such as segments 2, 3, etc., (not shown), each of which may thither define Service A 214 or another service in the bit stream 210. The illustration in FIG. 2 is not meant to be limiting. Different numbers and types of channels, services, segments, etc., may exist in other examples.

Returning to FIG. 1, the memory unit 134 may store service information, such as the service information described in FIG. 2, or other information for subsequent retrieval. To facilitate such storage and retrieval, the memory unit 114 may include a plurality of addresses or memory locations. Various types of the memory 134 may exist in various implementations. Example types of memory may include random access memory ("RAM"), flash RAM, magnetic media, optical media, computer-readable storage media. The memory unit 114 may also include non-volatile memory, solid state memory, magnetic memory, semiconductor memory, etc.

An encoder unit 138 may access the service information in the memory unit 134 and encode the service information onto a signal, e.g., signal 104, for transmission to a receiver device 106 via the RE transmission unit 132, in one embodiment. One or more bit streams of digital content or data may also be encoded onto the signal 104. The digital data may include, but is not limited to, digital audio, traffic, and data. In some embodiments, the digital data in the signal 104 may include data generated via analog and digital modulations. For example, the signal 104 may have an analog signal of a talk radio channel, a digital audio of a music channel, and traffic data for use by in-vehicle navigation systems. Thus, a bit stream may carry several different services modulated using analog and digital modulation. In other embodiments, the signal 104 may include an analog signal and one or more digitally modulated sidebands.

Various techniques may be utilized to encode service information, or other information or data. Such encoding techniques may include, but are not limited to, orthogonal frequency division multiplexing (OFDM). Various other analog, digital, other techniques, or a combination thereof, may be used in other embodiments. The techniques may provide for error correction, resistance to adverse channel conditions such as fading, data compression, and so forth. In one embodiment, the signal 104 may be compliant with one or more standards set forth by the National Radio Systems Committee ("NRSC") located in the United States and co-sponsored by the National Association of Broadcasters and the Consumer Electronics Association. For example, the signal 104 may be broadcast according to the HD Radio™ air interface promulgated by the NRSC.

The RF transmission unit 132 may modulate the encoded service information in the signal 104 using various modulation techniques, such as amplitude modulation, frequency modulation, phase modulation, etc.

This signal 104 may be received by one or more receivers 106. These receivers 106 may include portable radios, in-vehicle entertainment, systems, smartphones, laptops, netbooks, mobile handsets, and so forth. The receiver 106 may be configured to present at least a portion of the content or data contained in the signal 104 to one or more users 108 or another device. For example, the receiver 106 may be configured to demodulate and decode the digital audio of the music channel into an audible signal for output by a speaker, as well as provide the traffic data to the in-vehicle navigation system.

A signal 104 may be transmitted over various channels. In one embodiment, service boundary information may be transmitted over a channel that is different than the channel over which data may be transmitted. In one example, service boundary information may be transmitted over a PIDS IBOC channel, while content or data associated with a service may be transmitted over a different IBOC channel. According to this example, the PIDS channel may represent a low latency (e.g., relatively small time delay), fast logical channel, that may process data or other information faster than channels having, a relatively high latency or time delay over which the service data may be transmitted. Such a configuration may enable a receiver device 106 to receive and identify service boundary information before receiving and processing service data. In this way, as will be described in greater detail below, a receiver device may process service data associated with a service based at least in part on the service boundary information associated with the service.

A physical layer interface in the receiver 106 may include an RF unit 110 and a signal processing unit 112. The RF unit 110 may be configured to provide for reception of one or more radio frequency signals, such as signal 104, at one or more frequencies. According to one configuration, the RF unit 110 may include an amplifier, a mixer, a local oscillator, and so forth. The RF unit 110 may be implemented as discrete electronic components, integrated circuits, software-defined radio, or a combination thereof.

The signal processing unit 112 may include a memory unit 114, a decoder unit 116, and audio/data processing unit 118. The memory unit 114 may be configured to store one or more bits for subsequent retrieval and may, in one embodiment, be the same or at least similar to the memory unit 134 located at the transmitter device 102. In one embodiment, the memory unit 114 may be a constrained or limited amount, such as less than or equal to about 300 kilobytes.

The decoder unit 116 may be configured to decode signals received by the RF unit 110. The audio/data processing unit 118 may extract audio and/or data service information from output of the decoder unit 116 and process the information, among other functions. For example, the audio/data analysis module 118 may decompress audio services according to various formats, such as, but not limited to pulse code modulated ("PCM") samples. At least a portion of the PCM samples may be presented to the user through speakers. As another example, the audio/data analysis module 118 may process data services, traffic services, and ad services, as non-limiting examples. At least a portion of the processed output may be presented on a display or provided to another unit for further processing.

The signal processing unit 112 may be configured such that at least the memory unit 114 and the decoder unit 116 may be disposed on a common integrated circuit die, in one embodiment. In another embodiment, the memory unit 114 may be integrated with the decoder unit 116. Other units, components, or modules may be combined or shared, such as the RF unit 110 and the signal processing unit 112, in other embodiments.

In some implementations, the receiver 106 may include a processor (not shown) having one or more cores and configured to access and execute at least in part instructions stored in one or more memories coupled to the processor to perform certain actions or functions. Such a processor may be used in conjunction with the signal processing unit 112 to provide associated functions, other functions, or a combination of both.

A display 120 may be incorporated into the receiver 106 which to present visual information to the user 108. In one embodiment, the display 120 may present information in the signal 104 as received and decoded by the signal processing unit 112. For example, where the signal 104 includes the digital audio of the music channel, the display 120 may provide a name of the song currently being broadcast and the artist performing as provided by the audio/data processing unit 118. Example types of the display 120 may include a liquid crystal display, plasma display, cathode ray tube, light-emitting diodes, etc.

The receiver device 106 may also include one or more speakers 122. The speakers 122 may be configured to accept a signal generated by the signal processing unit 112, such as PCM samples, and present sound to the user. For example, the signal processing unit 112 may output a signal to drive the speakers 122, which may generate an audible representation of at least a portion of the data in the signal 104.

The receiver 106 may also incorporate one or more input/output (I/O) interfaces 124. The I/O interfaces 124 may allow for coupling devices such as keyboards, joysticks, touch sensors, cameras, microphones, speakers, external memories, navigation devices, and so forth to the receiver 106. For example, a serial peripheral interface ("SPI") may be provided to transfer traffic data present in the signal 104 to a navigation device.

The receiver 106 may be installed in or integrated with other devices, in some embodiments. For example, in one embodiment, the receiver 106 may be part of a smartphone or a vehicle entertainment system, as non-limiting examples. The receiver 106 may also share one or more components with other devices. For example, when integrated into a smartphone, the receiver 106 may present data from the signal processing unit 112 to the display or speakers of the smartphone. The receiver 106 may also receive user input when used in such fashion.

Figure 3:
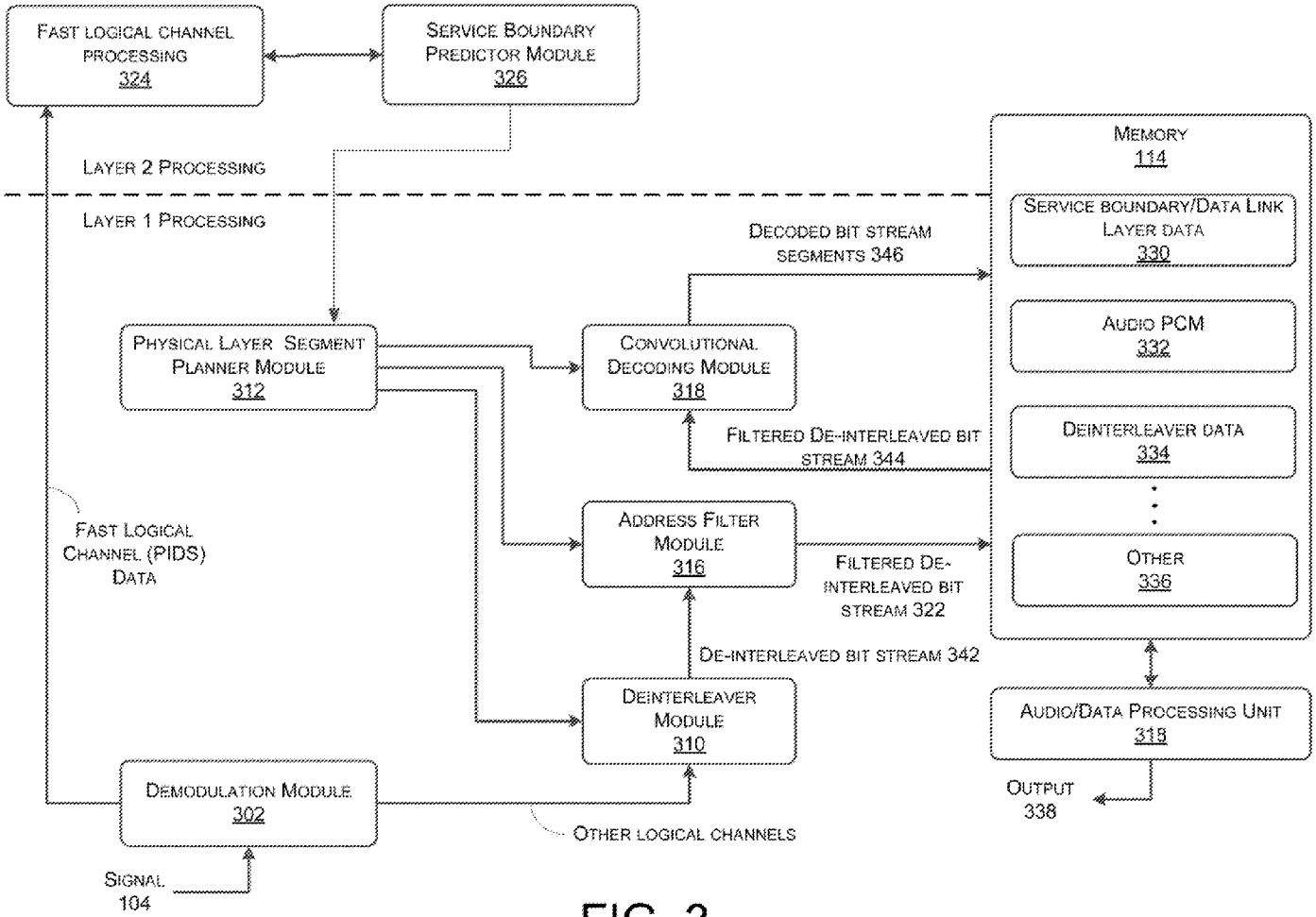
FIG. 3 illustrates a block diagram of modules in a signal processing unit for processing IBOC services, according to one embodiment of the disclosure.

FIG. 3 illustrates a block diagram of modules in a signal processing unit for processing IBOC services, according to one embodiment of the disclosure. In one embodiment, the signal processing unit may be implemented by the signal processing unit 112 in FIG. 1. For illustrative purposes, and not by way of limitation, the modules and associated data may be referred to as operating at a physical layer (or "layer 1") or a data link layer (or "layer 2"). Layer 1 may be configured to handle with raw associated with service content or data. Layer 2 may address how the data is mapped to different services and may do so, at least in part, by processing service information, such as boundary information for segments associated with a service. A dotted line 301 in FIG. 3 may indicate a separation between layer 1 processing as implemented by modules above line 301 and layer 2 processing as implemented by modules below line 301.

Also for illustrative purposes, and not by way of limitation, the modules herein are shown interconnected in one configuration. In other implementations, other interconnection configurations may be used. The following modules may be implemented as application-specific integrated circuits ("ASICs"), field programmable gate arrays ("FPGAs"), software-defined radios ("SDRs") executing on a processor, and so forth. The modules described herein may be implemented as a plurality of circuit elements on a single integrated circuit die.

A demodulation module 302 may perform a number of functions to facilitate the processes described herein. One such function may include demodulating, a received signal 104, or other signals. In one embodiment, the demodulation module 302 may be configured to demodulate an orthogonal frequency-division multiplexed ("OFDM") signal. Other types of signals, such as amplitude modulation, frequency modulation, or phase modulation signals, among others, may be demodulated by the demodulation module 320 in other embodiments. The results of the demodulation may include a demodulated bit stream, which the demodulation module 302 may output. Another function that may be performed by the demodulation module 302 may include directing the demodulated bit stream to various modules or units in the signal processing unit. Directing demodulated information may include the demodulation module 302 extracting at least a portion of a signal, such as the signal 104. For example, in one embodiment, service data (such as content associated with one or more services) may be extracted and passed to the deinterleaver module 310, while service information may be extracted and passed to the fast logical channel processing module 328.

As described, service information may be received over a fast logical PIDS channel according to the IBOC standard. Service data, however, may be received over one or more other logical channels, as indicated in FIG. 3, such as IBOC logical data channels (e.g., P1, P2, P3, etc.). According to one configuration, information sent over the fast logical PIDS channel may be processed relatively fast by compared to other logical channels by virtue of relatively small packet sizes and/or a relatively short interleaving process (e.g., that may only span across one frame of multiple frames) that may require a relatively small amount of memory (e.g., as compared to interleaving processes for other logical channels), in one embodiment. In this way, service information, such as service boundaries, may be used to filter service data before it arrives at the signal processing unit. In some examples, service data may arrive before service information and therefore may not be filtered according to service boundaries of segments associated with a service of interest. For example, service data may not be filtered when a receiver is first activated and a service has not yet been selected as a service of interest.

A dynamic memory management module (not shown) may perform various functions to facilitate decoding of IBOC services. For example, the dynamic memory management module may allocate memory for storing data or other information associated with layer 1 processing and/or layer 2 processing. The memory unit 314, by virtue of being shared across layer 1 and layer 2 modules, may be allocated in such fashion by the dynamic memory management module. For example, at least portions of the service boundaries or data link layer data 330, audio pulse code modulation ("PCM") data 332, deinterleaver data 334, and other data 336 in the memory unit 314 may be allocated.

Dynamic allocation of memory may mean that varying amounts of the memory may be allocated for layer 1 and layer 2 processing. Such variations may be based on the priorities of the signal processing unit, which may be predetermined priorities, priorities that are determined based on service information (e.g., received from the demodulation module 302), or other factors. For example, the priorities may be based on the type of service, quality of service, number of services that require decoding, other indications in the service information, etc. In one embodiment, priorities may be used to allocate the memory unit 314 such that audio services are given first priority, followed by data services, or vice versa.

According to one example, the memory unit 314 may be insufficient for all operations demanded. For example, should the user 108 in FIG. 1 select to have all services in the signal 104 decoded, there may be insufficient memory for audio data 332, deinterleaver data 334, etc. in these instances, the dynamic memory management module may alter the memory resource allocation to improve or degrade the service and/or performance of the signal processing unit to meet the demands requested of the receiver 106. Such alterations to memory resource allocation may be performed to maintain a pre-determined quality of service, in one embodiment. For example, a particular audio service may be designated such that it is to be provided at a highest available bit-rate. Thus, memory may be allocated to maintain such highest available bit-rate at the expense of degrading other services. Numerous other examples of memory allocation may exist in other embodiments. These examples may be based on different demands on a receiver 106, received by the receiver 106, available information, desired outputs by the receiver 106, etc. For example, it may be desirable improve filtering of service data of interest in layer 1 at the expense of potentially dropping some services in a bit stream.

The fast logical channel processing module 328 may perform functions to facilitate efficient decoding of IBOC services. One such function may include extracting service information from the fast logical channel, e.g., the PIDS IBOC channel. In one embodiment, the extraction may be required when various information in addition to service information is received over the fast logical channel. In these instances, the fast logical channel processing module 328 may extract only relevant information, e.g., service information, to facilitate efficient decoding of IBOC services. The fast logical channel processing module 328 may also preassemble extracted service information, for example, as a result of the service information being segmented across multiple frames in the logical channel, in one embodiment. Thus, the fast logical channel processing module 328 may collect, each segment of service information and assemble the segments as a single bit stream of segments corresponding to service information for processing by other modules in the signal processing unit, as will be described in detail below.

Another function performed by the fast logical channel processing module 328 may include performing various checks on the information received over the fast logical channel. For example, various checks on the validity and integrity of the information may be performed to identify any dropped packets, signal fading, manipulations of the information (e.g., in association with receiving secured or encrypted information), or other checks to verify the trustworthiness of the information. Various techniques may be utilized to implement such checks, including checksum calculations, hash functions, etc.

A service boundary extraction module 326 may receive service information, for example, from the fast logical channel processing module 328. The service boundary extraction module 328 may parse the information to determine service boundaries for a service of interest, in one embodiment. Each segment associated with a service may include a header portion and a payload portion. The header portion may follow a particular format, e.g., IBOC PIDS format, that may facilitate parsing of the service information, including the service boundaries. The actual content of tile service information may be included in the payload portion of a segment.

As described, service boundaries may describe a starting bit offset for a segment in a bit stream associated with a service of interest, a length of the segment (which may be used by the service boundary extraction module 326 to calculate an ending bit, e.g., by summing the start bit offset by the segment length), the number of segments in a bit stream associated with a service (such as the service of interest), one or more logical channels over which the segments may be identified, and the type of service associated with the segment, among other information. Thus, according to one example, the service boundary extraction module 326 may parse service information for a particular service of interest, such as a jazz music channel selected by a user 108 utilizing a receiver 106 in FIG. 1. Thus, the above service boundary information associated with the jazz music channel may be selected from the service information. Using this approach, the service boundary extraction module 326 may capture information that may enable optimized decoding of IBOC services, as will be further described below. A more detailed example describing the functionality of the service boundary extraction module 326 and other modules is provided in association with FIG. 4.

In one embodiment, the layer 1 or physical segment planner module 312 may receive the service boundary information from the service boundary extraction module 326 and divide a layer 1 frame bit stream into segments according to the service boundaries. In so doing, the physical segment planner module 312 may configure other modules in the signal processing unit to filter a service of interest from multiple services in a bit stream, according to one embodiment. For example, the physical segment planner module 312 may configure a convolutional decoder block, e.g., a Viterbi decoder block, into segments according to addresses associated with the services of interest. As used herein, "addresses" may refer to the start bit offset of a segment associated with a service of interest and the end bit of a segment associated with a service of interest. As described, the end bit may be calculated by summing the length of a segment with the start bit offset. In one embodiment, the Viterbi block may be configured to use and/or apply a different number of soft bits per each segment associated with a service of interest.

The physical segment planner module 312 may also translate the addresses into deinterleaved addresses and may provide the deinterleaved addresses to the address filter module 316, according to one embodiment. The address filter module 316 may permit only bits in a bit stream of service data that are within the desired addresses (e.g., between respective start offset bits and end offset bits) to be filtered and stored into the memory unit 314.

A deinterleaver module 310 may be coupled to the demodulation module 302. The deinterleaver module 310 may accept the demodulated bit stream and deinterleave the data included in the demodulated bit stream. Interleaving of blocks of data in frequency and time may be done for a variety of reasons. For example, interleaving may mitigate effects of interference in the radio channel associated with the signal 104. The deinterleaver module 310 may be configured to deinterleave one or more different interleaving formats. These formats may include block interleaving, convolutional interleaving, etc.

The deinterleaver module 310 may output a deinterleaved bit stream 342 to the address filter module 316. As described, the address filter module 316 (which may be coupled to the deinterleaver module 310) may be receive deinterleaved addresses of a service of interest from the physical layer segment planner module 312 and select or filter bits from the deinterleaved bit stream 342 based at least in part on the deinterleaved addresses, in one embodiment. The deinterleaved addresses may include data about locations of segments associated with one or more services of interest in the deinterleaved bit stream 342, which may be at least partially convolutionally encoded.

The output of the address filter module 316 may represent the filtered deinterleaved bit stream 344, which may be stored in the memory unit 314 or otherwise accessible to the convolutional decoding module 318. In one example, when no addresses are available to filter service data, all service data may be passed (e.g., to the memory unit 314) without filtering. For example, as described, when the signal processing unit (e.g., the signal processing unit 112 associated with the receiver 106) is first started and no services have been selected or designated as services of interest, the address filter module 316 may pass the deinterleaved bit stream 220 without modification. In some embodiments, assumptions may be made about a service of interest, such as a primary channel of digital audio, which may be initially selected and used for filtering.

By filtering the deinterleaved bit stream 220 to form the filtered deinterleaved bit stream 344, the amount of data to be stored and processed may be correspondingly reduced. The reduction in memory experienced upon implementing certain embodiments herein may therefore result in a smaller physical site of the memory unit 314 when constructed on an integrated circuit reducing the on-die footprint of the signal processing unit 112. Reductions in processor utilization, power consumption, etc., may also be realized due to the reduced volume of data in the filtered deinterleaved bit stream 344 compared to the deinterleaved bit stream 342. Such reductions may not be present in traditional decoders that may decode an entire physical layer frame.

The convolutional decoding module 318 may be configured to decode data that has been encoded using a convolutional algorithm or process. In one implementation, the convolutional decoding module 318 may be configured to use Viterbi decoding. In some embodiments, the convolutional decoding module 318 may retrieve the filtered deinterleaved bit stream 344 (e.g., as filtered by the address filter module 316) from the memory unit 114 and produce a decoded representation of the filtered deinterleaved bit stream (e.g., decoded bit stream segments 346). The decoded bit stream segments 346 may be stored in the memory unit 314.

The audio/data processing unit 118 in FIG. 1 may access the decoded bit stream segments 346, which may represent data associated only with a service of interest, further process the decoded bit stream segments 346 (e.g., decompressing, reformatting, or performing other manipulations of the bit stream segments 346), and provide output 338. The output 338 may be presented to the display 120, the speakers 122, etc.

The above configuration in FIG. 3 is non-limiting. Different configurations may exist in other embodiments. For example, all or at least a portion of the functions described above may be performed by any of the modules in FIG. 3, in some embodiments. For example, the processes performed by the a'1 logical channel processing module 328 may be performed by the service boundary extraction module 326. As another example, the address filter module 316 may be integrated with or otherwise combined with the deinterleaver module 310. Some configurations may also facilitate sharing functionality across layers such that at least a portion of layer 1 functionality may be performed by layer 2 functionality, and vice-versa.

Figure 4:
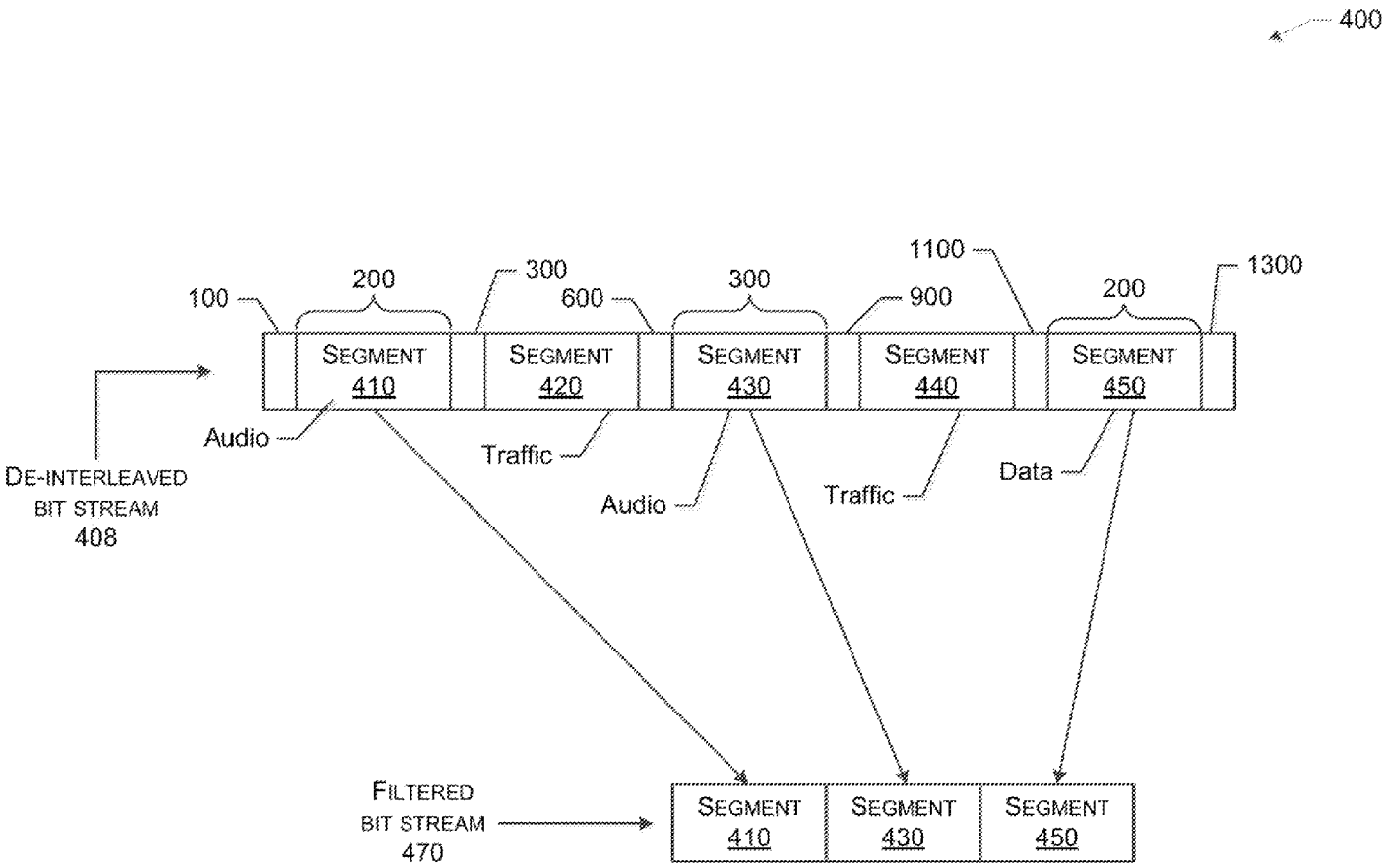
FIG. 4 illustrates a bit stream of frame segments associated with a service of interest and corresponding segments that are filtered from multiple services in the bit stream, according to one embodiment of the disclosure.

FIG. 4 depicts a bit stream of frame segments associated with a service of interest and corresponding segments that are filtered from multiple services in the bit stream, according to one embodiment of the disclosure. As shown in FIG. 4, a bit stream 408 may include segments associated with multiple types of services, such as an audio service, traffic service, and a data service. The audio service may include segments 410 and 430; the traffic service may include segments 420 and 440; and the data service may include segment 450. Although a specific number of services are illustrated, different numbers of such services may exist in other embodiments. In some embodiments, multiple services may exist for each type of service. For example, audio for a jazz music channel and a pop music channel, both of which are types of audio services, may be included in the bit stream 408. Additionally and/or alternatively, multiple bit streams may each carry segments associated with a service of interest, although only one such bit stream is shown in FIG. 4. In one embodiment, the deinterleaved bit stream 408 may embody the deinterleaved bit stream 342 in FIG. 3.

In the example illustrated in FIG. 4, it is assumed that a user 108 in FIG. 1 has utilized the receiver 106 to select the jazz music channel as the service of interest, as represented by audio segments 410 and 430. A data segment 450 may also be associated with the jazz music channel and may provide information identifying the jazz music channel (e.g., name of artist, title of the song, year recorded, etc.) to a display, such as a display 120 that may be viewed by the user 108. It is also assumed, for purposes of illustration, that the bit stream 408 was received over one logical data channel, e.g., PIDS logical data channel P1. According to the PIDS IBOC standard, multiple logical data channels may be used for transmitting service content or data, for example, from a transmitter device, such as transmitter 102, to a receiver device, such as receiver 106 (both shown in FIG. 1). Whether multiple logical data channels exist may be determined from service information extracted by the service boundary extraction module 326 in FIG. 3, in one embodiment. For example, extracted service boundary information may include a logical channel identifier, e.g., logical channel 232 in FIG. 2, that may indicate a logical channel associated with each segment associated with a service of interest.

The extracted service boundary information may also indicate that three services exist in the deinterleaved bit stream 408, e.g., jazz music audio, traffic, and data. The service boundary information may further indicate that five (5) segments exist, e.g., segments 410, 420, 430, 440, and 450. The extracted service boundary information may further indicate the addresses of the segments, or the start offset bit number and end offset bit number for each segments associated with the jazz music audio service. In one embodiment, the start offset bit and the length for each segment associated with a service of interest may be included in the service information. The start bit and the length are shown in FIG. 4 and will be described further below. In other embodiments, the start bit and the end bit may be used. When the end bit it used, it may be calculated at least in part by summing the start bit position and the length of the segment having the start bit position. In the example of FIG. 4, end bit 300 may be calculated by summing start bit 100 with a segment length 200 as shown; end bit 900 may be calculated by summing start bit 600 with a length of 300; and end bit 1300 may be calculated by summing start bit 1100 with a length of 200. Such start bits and end bits may represent addresses for each segment associated with a service of interest.

In one embodiment, the addresses for the jazz music segments (e.g., as identified by the service boundary extraction module 326) may be used to configure a convolutional decoder (e.g., the convolutional decoding module 318) and an address filter (e.g., the address filter module 316) such that only bits for the identified addresses associated with the jazz music service of interest are selected and stored in memory. In the present example, such configurations may cause the address filter module to select bits 100 to 300, bits 600 to 900, and bits 1100 to 1300. Such filtering may be implemented by designating segments associated with these start bit and end bit ranges in a bit stream of one or more segments, such as the deinterleaved bit stream 408; configuring a convolutional decoding module (e.g., convolutional decoding module 318) into segments according, to the start bits and end bits of the designated segments; and providing the deinterleaved addresses to the address filter, address filter module 316, to configure the address filter to select only bits associated with the deinterleaved addressed. In one embodiment, such functions may be performed by the physical layer segment planner module 312.

The result of filtering the deinterleaved bit stream 408 in the above manner may be the filtered bit stream 470, which reflects a concatenation of the services of interest in the present example. The audio portions of the jazz music service, or bits 100 to 300 and 600 to 900, or a representation of such bits after the bits have been further processed, may be output to speakers, such as the speakers 122, while the data portion of the jazz music service (bits 1100 to 1300) may be output to a display, such as the display 120. In one embodiment, the audio/data processing unit 318 in FIG. 3 may determine to which output to send bits based at least in part on the type of service.

The above example is non-limiting. Different numbers of segments, bit streams, numbers and lengths of segments, types of services, etc., may exist in other examples. Further, indications of bit positions in the deinterleaved bit stream are for purposes of illustration only and are not meant to be exact. For example, bit position 300 is not meant to point exactly to the point in the deinterleaved bit stream at which the segment 420 begins. Further, for purposes of illustration, an ending bit position for one segment may be used as a starting bit position for another segment, such as an adjacent segment. In other examples, the starting bit position for the adjacent segment may be incremented by at least one bit or may reflect padding that may be provided between each segment.

Figure 5:
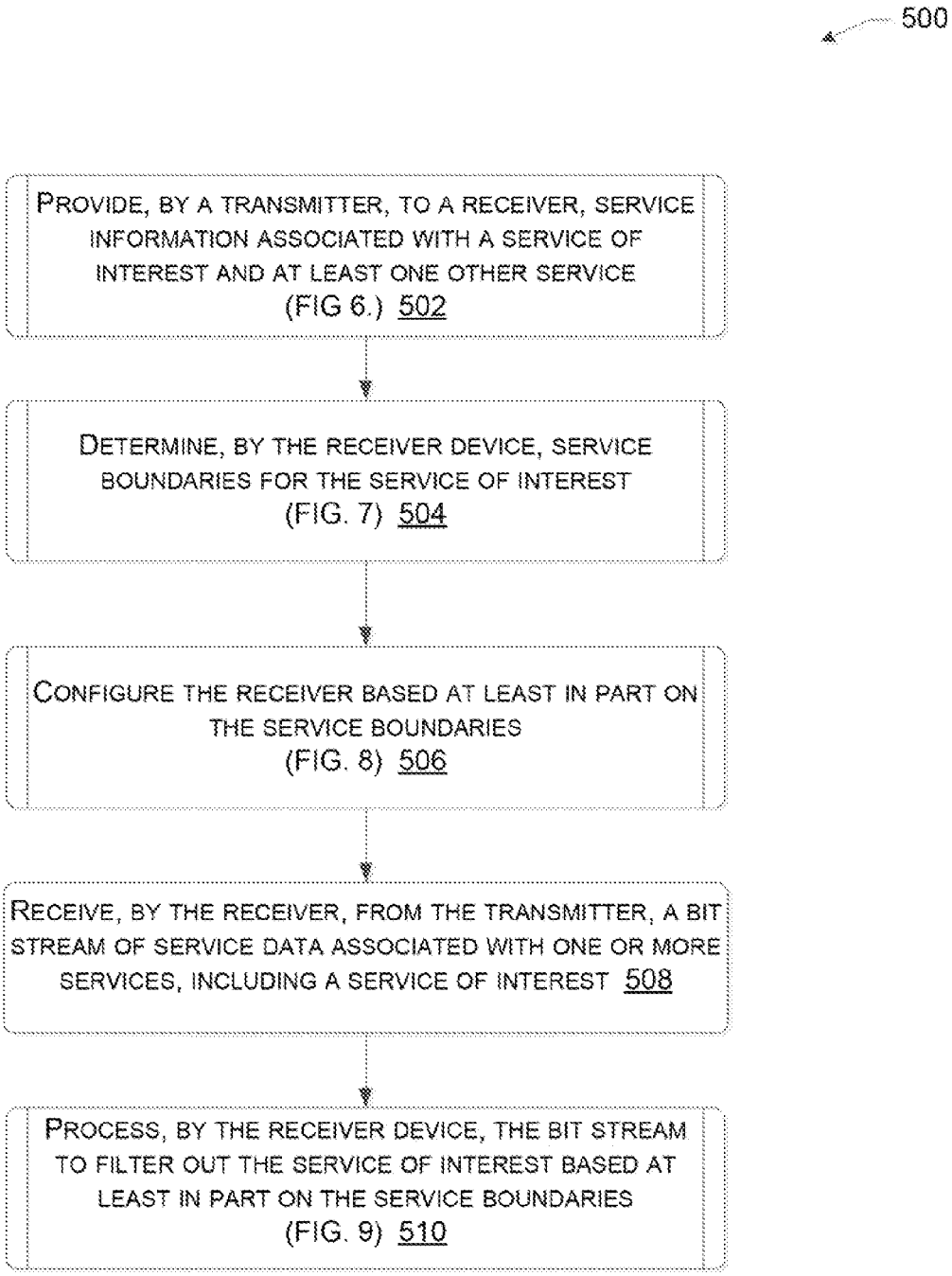
FIG. 5 illustrates a flow diagram of a process for processing IBOC services in accordance with certain embodiments herein.

FIG. 5 depicts a flow diagram of a process for processing IBOC services in accordance with certain embodiments herein. The processing may begin at block 502, where service information may be provided from a transmitter device, such transmitter 102, to a receiver device, such as receiver 102. Such processing is described in association with FIG. 6.

At block 504, service information, such as service boundaries for segments associated with a service of interest, may be determined by the receiver device. A description of the processes included in making the determination is described M association with FIG. 7.

At block 506, modules in a signal processing unit, such as the signal processing unit 112, may be configured according to the service boundary information associated with a service of interest. As described, the modules may be configured to extract one or more services of interest from a bit stream including multiple services that may not be desired by the receiver 106. A description of the processes associated with configuring a signal processing unit accordingly is provided in FIG. 8.

A bit stream of service data associated with one or more services may be received, at block 508. Such a bit stream may include a service of interest. At block 510, the bit stream may be processed according to the service boundaries such that the service of interest may be extracted from the bit stream and output at the receiver 106, such as to speakers, a display, etc. A description of such processing is provided in association with FIG. 9.

Figure 6:
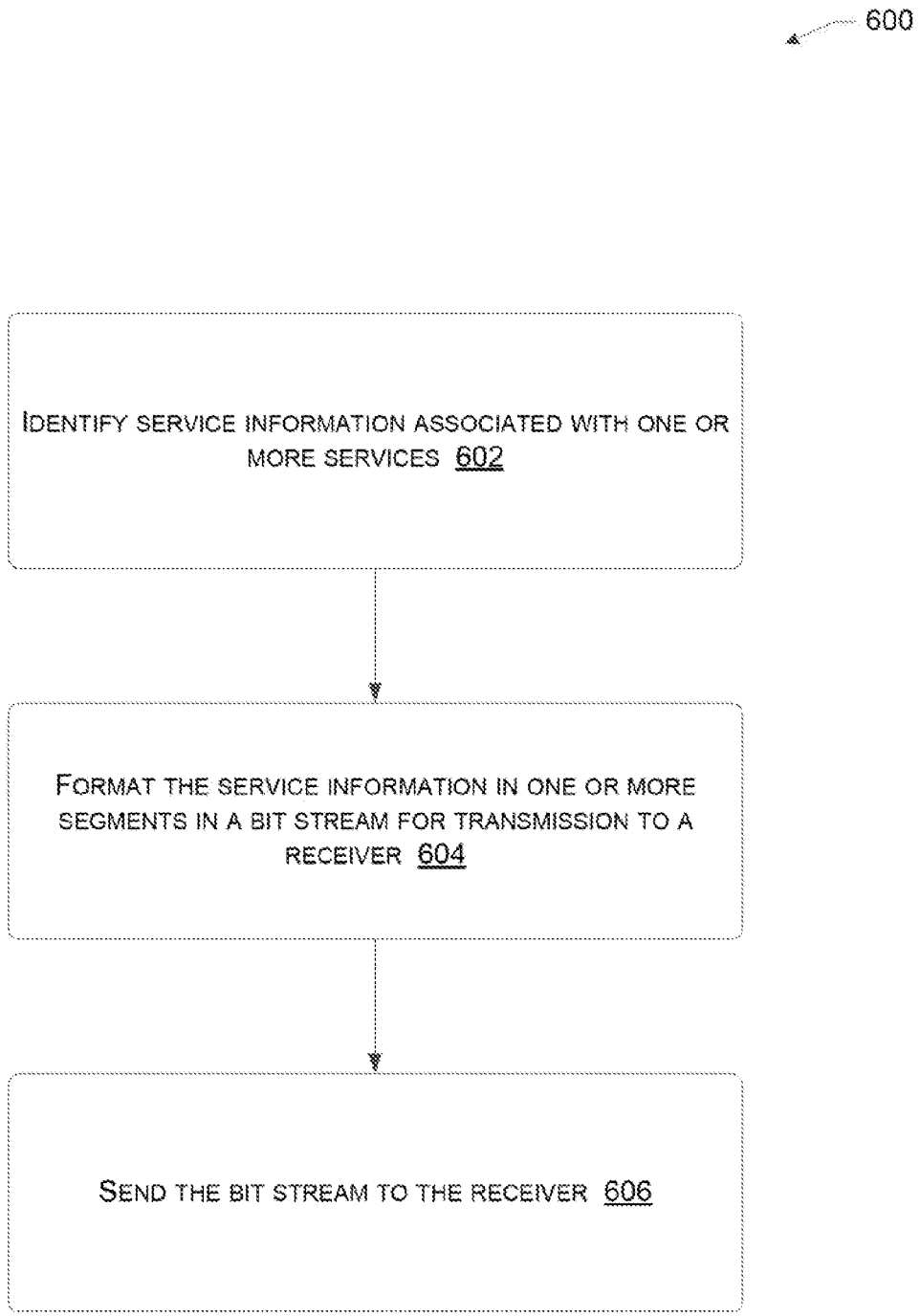
FIG. 6 illustrates a flow diagram of a process for providing service information to a receiver device, according to one embodiment of the disclosure.

FIG. 6 depicts a flow diagram of a process for providing service information by a transmitter, according to one embodiment of the disclosure. In one embodiment, the process may be performed by the transmitter 102 in FIG. 1. The processing may begin at block 602, where service information associated with one or more services may be identified, e.g., by the audio/data service generation unit 136. The service information may be identified from one or more data sources, databases, etc., that may have such information available. The service information may include service boundary information that may be used to create one or more segments or packets associated with a service of interest. As described, the service information may include a description of a service type, an identification of one or more logical channels over which the segment may be transmitted, a segment count or a number of segments associated with the service type that are included in a bit stream, the start bit for the segment, and the size of the segment. Additional information may be included in other embodiments, such as the end bit of the segment, which may be calculated by the audio/data service module 136 and included in the service information transmitted to a receiver.

The service information may be formatted for transmission to a receiver, e.g., by the audio/data service module 136, at block 604. In one embodiment, each header of a segment associated with a service may include the service information formatted according to the PIDS IBOC standard. Formatting the service information may include encoding the service information using various encoding, techniques, such as OFDM, as a non-limiting example.

The generated bit stream which includes segments associated with services, including a service of interest, may be transmitted to a receiver, such as the receiver 106, at block 606. In one embodiment, the service information may be sent over a fast logical PIDS channel, which may be a low latency channel serving as a control channel over which the service information may travel. Utilizing a fast logical PIDS channel to send service information may facilitate configuring a receiver to select only a service of interest before service data including one or more services of interest arrives at the receiver.

Figure 7:
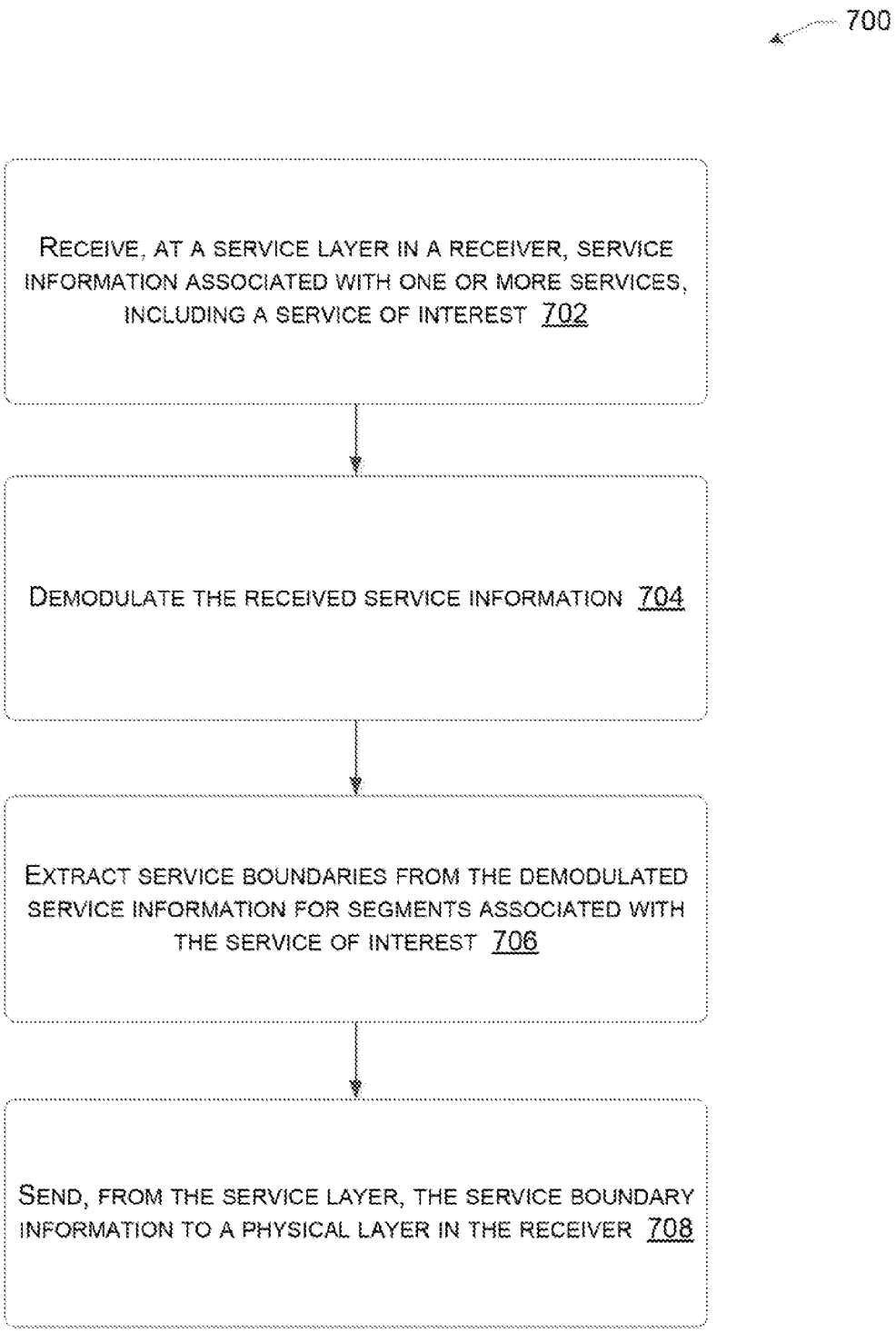
FIG. 7 illustrates a flow diagram of a process for determining service boundaries for a service of interest, according to one embodiment of the disclosure.

FIG. 7 depicts a flow diagram of a process for determining service boundaries for a service of interest, according to an embodiment of the disclosure. The process may begin at block 702, where service information associated with one or more services, including a service of interest, may be received in layer 2 (or the data link layer) of a signal processing unit, such as the signal processing unit 112 of the receiver 106, in one embodiment. The received service information may be demodulated to create a demodulated bit stream representing the service information, at block 704.

Service boundaries for segments associated with the service of interest may be identified in the demodulated service information, at block 706. Upon extracting such information, the start bit and end bit of each segment associated with the service of interest may be known. The identified service boundaries may be sent to a physical layer of the signal processing unit, at block 708, where it may be used to configure modules in the physical layer to select and store only those segments associated with the service of interest, in one embodiment.

Figure 8:
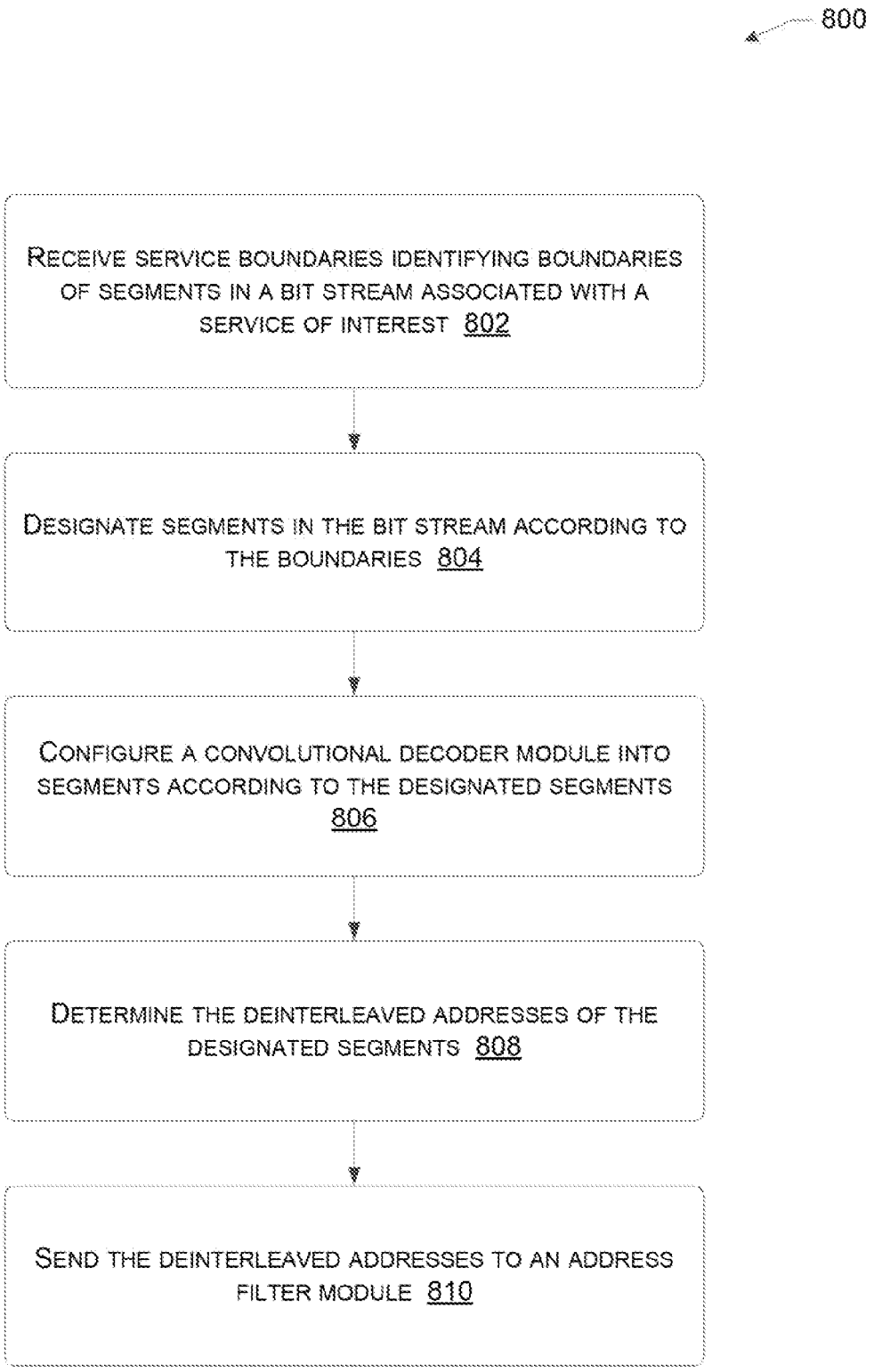
FIG. 8 illustrates a process for configuring a signal processing unit in a receiver for selecting segments associated with a service of interest, according to one embodiment of the disclosure.

FIG. 8 depicts a process for configuring a signal processing unit for selecting segments associated with a service of interest, according to one embodiment of the disclosure. In one embodiment, the process may be performed by a physical layer in the signal processing unit, such by the modules in layer 1 in FIG. 3. The process may begin at block 802, where service boundaries or addresses associated with a service of interest may be received. At block 804, segments in a bit stream of services may be designated according to the service boundaries, e.g., by the physical layer segment planner module 312. A convolutional decoder, such as a Viterbi decoder may be configured into segments according to the addresses of the designated segments, at block 806. Deinterleaved addresses of the designated segments may be determined, e.g., by the physical layer segment planner module 312, at block 808. The deinterleaved addresses may be sent to an address filter, e.g., address filter module 316, to configure the address filter to select or filter only bits associated with the deinterleaved addressed.

Figure 9:
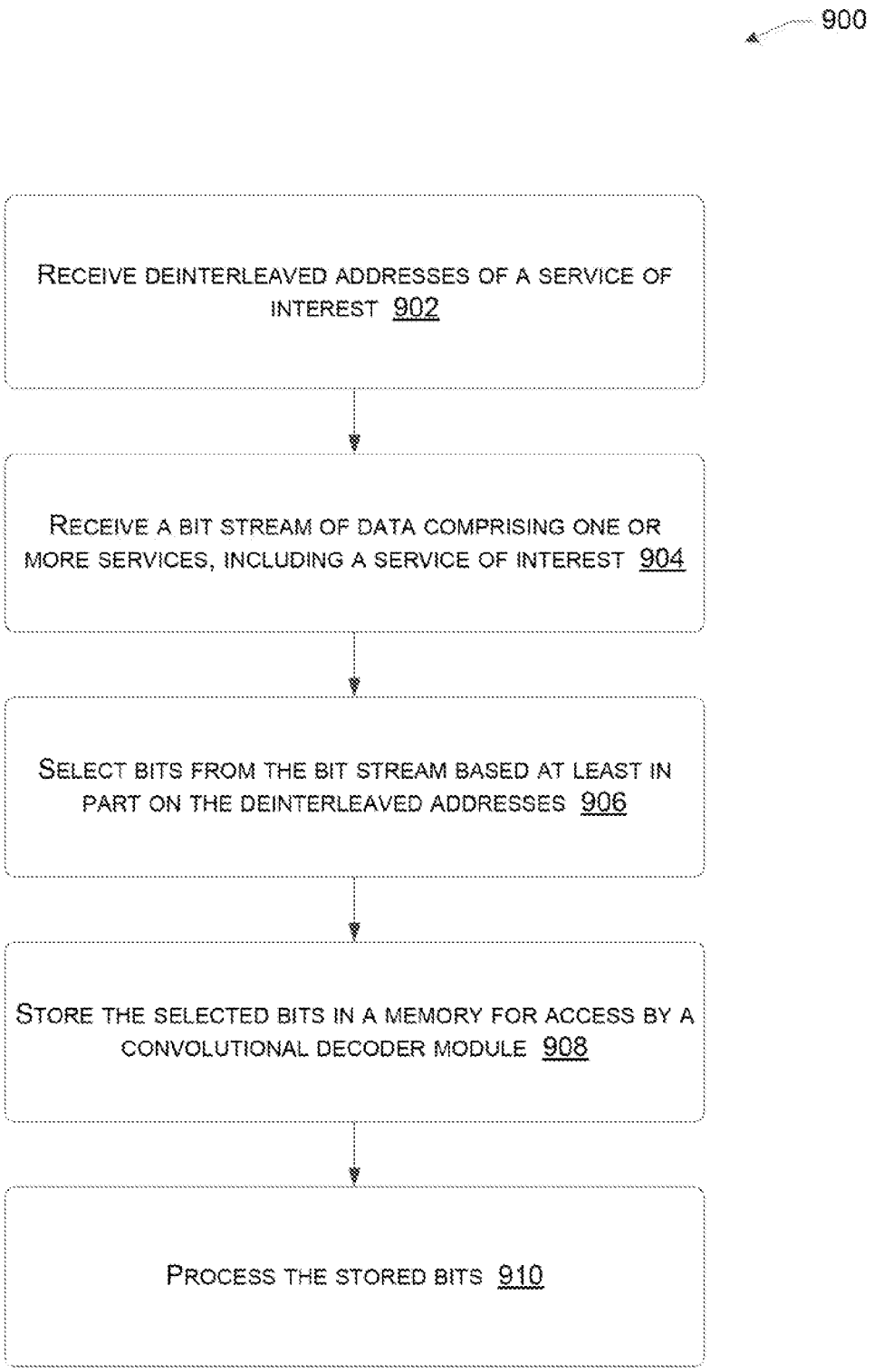
FIG. 9 illustrates a flow diagram of a process for filtering a bit stream of one or more services to obtain content or data associated with a service of interest, according to one embodiment of the disclosure.

FIG. 9 depicts a flow diagram of a process fir filtering a bit stream of one or more services to obtain data associated with a service of interest, according to one embodiment of the disclosure. Deinterleaved addressed associated with a service of interest may be received, at block 902. A bit stream including one or more services, including a service of interest, may be received at block 904. One or more services of interest may be received, identified, and selected, in some embodiments. Bits associated with the service of interest may be selected from the bit stream based at least in part on the deinterleaved addressed, at block 906. At block 908, the selected bits may be stored in a memory, such as the memory unit 314, where they may be accessed and processed, e.g., by the audio/data processing unit 118, which may output the stored bits to speakers, a display, etc., associated with a receiver, at block 910.

The operations and processes described and shown above may be carried out or performed in any suitable order as desired in various implementations. Additionally, in certain implementations, at least a portion of the operations may be carried out in parallel. Furthermore, in certain implementations, less than or more than the operations described may be performed.

Certain aspects of the disclosure are described above with reference to block and flow diagrams of systems, methods, apparatuses, and/or computer program products according to various implementations. It will be understood that one or more blocks of the block diagrams and flow diagrams, and combinations of blocks in the block diagrams and the flow diagrams, respectively, can be implemented by computer-executable program instructions. Likewise, some blocks of the block diagrams and flow diagrams may not necessarily need to be performed in the order presented, or may not necessarily need to be performed at all, according, to some implementations.

These computer-executable program instructions may be loaded onto a special-purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable storage media or memory that can direct a computer or other programmable data processing apparatus to function in a particular manner, such that the instructions stored in the computer-readable storage media produce an article of manufacture including instruction means that implement one or more functions specified in the flow diagram block or blocks. As an example, certain implementations may provide for a computer program product, comprising a computer-readable storage medium having a computer-readable program code Or program instructions implemented therein, said computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks.

Accordingly, blocks of the block diagrams and flow diagrams support combinations of means for performing the specified functions, combinations of elements or steps for performing the specified functions and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. An apparatus comprising: a memory; and a signal processing unit coupled to the memory, the signal processing unit comprising: at least one physical layer segment planner coupled to the memory; and at least one service boundary extraction coupled to the memory and the at least one physical layer segment planner; wherein the at least one service boundary extraction performs operations comprising: receiving service information associated with one or more services; and extracting, from the service information, service boundaries for one or more segments associated with a service of interest; and sending the service boundaries to the at least one physical layer segment planner; wherein the at least one physical layer segment planner configures at least one address filter in the signal processing unit to select the one or more segments from a bit stream of segments associated with the one or more services based at least in part on the service boundaries; wherein the service information is received over a first channel and the bit stream is received over a second channel, wherein the first channel has a lower latency than a latency associated with the second channel.

2. The apparatus of claim 1, wherein the at least one physical layer segment planner is associated with a physical layer of the signal processing unit and the at least one service boundary extraction is associated with a data link layer of the signal processing unit, the data link layer coupled to the physical layer.

3. The apparatus of claim 1, wherein the at least one physical layer segment planner further performs operations comprising: designating the one or more segments in the bit stream associated with the service of interest; configuring a convolutional decoding to decode the designated one or more segments; determining deinterleaved addresses of the designated one or more segments based at least in part on the service boundaries; and providing the deinterleaved addresses to the at least one address filter for selecting the one or more segments from the bit stream.

4. The apparatus of claim 1, wherein the signal processing unit comprises a dynamic memory management coupled to the memory, wherein the dynamic memory management determines an allocation of the memory based at least in part on the service information.

5. The apparatus of claim 1, wherein the at least one address filter coupled to the at least one physical layer segment planner, and wherein the signal processing unit further comprises: a deinterleaver coupled to the physical layer segment planner; a convolutional decoder coupled to the physical layer segment planner; a dynamic memory management coupled to the memory; and a demodulation coupled to the dynamic memory management.

6. The apparatus of claim 1, wherein the at least one address filter performs the operations comprising: storing the one or more segments in the memory; and processing the one or more segments to generate one or more respective second segments; and outputting the one or more respective second segments to at least one of a speaker or a display associated with the apparatus.

7. The apparatus of claim 1, wherein the one or more segments comprise one or more first segments, wherein the service information comprises a type associated with the one or more services, an identification of one or more logical channels over which one or more respective second segments associated with the one or more services are transmitted, a number of the one or more respective second segments, a respective start offset bit for the one or more respective second segments, and a respective length of the one or more respective second segments.

8. The apparatus of claim 1, wherein the first channel is a PIDS fast logical channel.

9. One or more non-transitory computer-readable media storing computer-executable instructions that, when executed by at least one processor, configure the at least one processor to perform operations comprising:

receiving, at a receiver device, service information associated with one or more services;

identifying, by the receiver device, service boundaries of one or more first segments associated with a service of interest based at least in part on the information; and selecting, by the receiver device, the one or more first segments from a bit stream comprising one or more second segments associated with the one or more services, the selection based at least in part on the service boundaries;

wherein the service information is received over a first channel and the bit stream is received over a second channel, wherein the first channel has a lower latency than a latency associated with the second channel.

10. The one or more non-transitory computer-readable media of claim 9, the at least one processor further configured to perform the operations comprising:

designating the one or more first segments in the bit stream associated with the service of interest;

decoding the designated one or more first segments;

determining deinterleaved addresses of the designated one or more first segments based at least in part on the service boundaries, wherein the deinterleaved addresses are utilized to select the one or more first segments from the bit stream.

11. The one or more non-transitory computer-readable media of claim 9, the at least one processor further configured to perform the operations comprising:

storing the one or more first segments in a memory; and processing the one or more first segments to generate one or more respective third segments; and outputting the one or more respective third segments to at least one of a speaker or a display associated with the receiver.

12. The one or more non-transitory computer-readable media of claim 11, the at least one processor further configured to perform the operation comprising determining an allocation of the memory based at least in part on the service information.

13. The one or more non-transitory computer-readable media of claim 9, wherein the service information is received over a first channel and the bit stream comprising one or more second segments is received over a second channel, wherein the first channel has a latency that is lower than a latency associated with the second channel.

14. The one or more non-transitory computer-readable media of claim 9, wherein the service information comprises a type associated with the service of interest, an identification of one or more logical channels over which the one or more first segments are transmitted, a number of the one or more first segments, a respective start offset bit for the one or more first segments, and a respective length of the one or more first segments.

* * * * *